United States Patent [19]

Scheibner

[11] Patent Number: 4,795,269

[45] Date of Patent: Jan. 3, 1989

[54] CONTROLLED SEPARATION CHARACTERISTICS OF INTERLOCKING CLOSURE FASTENING DEVICES

[75] Inventor: Gerald H. Scheibner, Downers Grove, Ill.

[73] Assignee: First Brands Corporation, Danbury, Conn.

[21] Appl. No.: 509,708

[22] Filed: Jun. 30, 1983

[51] Int. Cl.[4] ..... B65D 33/16

[52] U.S. Cl. ..... 383/63

[58] Field of Search ..... 24/587; 383/63–65

[56] References Cited

U.S. PATENT DOCUMENTS

| | | | |
|---|---|---|---|
| Re. 27,174 | 9/1971 | Ausnit | 150/3 |
| Re. 28,969 | 9/1976 | Naito | 150/3 |
| 2,355,816 | 8/1944 | Morner | 24/206 |
| 2,581,604 | 1/1952 | Roehrl | 24/201 |
| 2,606,352 | 8/1952 | Wende | 24/201 |
| 2,909,822 | 10/1959 | Botti et al. | 24/201 |
| 2,975,496 | 3/1961 | McGraw | 24/201 |
| 3,226,787 | 1/1966 | Ausnit | 24/201 |
| 3,338,284 | 8/1967 | Ausnit | 150/3 |
| 3,338,285 | 8/1967 | Jaster | 150/3 |
| 3,347,298 | 10/1967 | Ausnit et al. | 150/3 |
| 3,372,442 | 3/1968 | Ishimatsu | 24/201 |
| 3,380,481 | 4/1968 | Kraus | 138/118 |
| 3,410,327 | 11/1968 | Ausnit | 150/3 |
| 3,416,199 | 12/1968 | Imamura | 24/201 |
| 3,425,469 | 2/1969 | Ausnit | 150/3 |
| 3,440,696 | 4/1969 | Staller | 24/201 |
| 3,557,413 | 1/1971 | Engle | 24/201 |
| 3,806,998 | 4/1974 | Laguerre | 24/201 C |
| 3,886,633 | 6/1975 | Ausnit | 24/201 C |
| 4,186,786 | 2/1980 | Kirkpatrick | 150/3 |
| 4,212,337 | 7/1980 | Kamp | 150/3 |

*Primary Examiner*—Stephen P. Garbe

*Attorney, Agent, or Firm*—Gary L. Wamer

[57] ABSTRACT

Interlocking closure fastening devices having controlled separation characteristics are provided wherein the interdigitating hooks on one side of each closure element are longer, and/or larger than the interdigitating hooks on the opposite side of each closure element. In another embodiment, the controlled separation characteristics are obtained by forming the profile portion of the closure elements from stiffer plastic material. Combination of the two embodiments provides optimum controlled separation characteristics.

46 Claims, 4 Drawing Sheets

CONTROLLED SEPARATION CHARACTERISTICS OF INTERLOCKING CLOSURE FASTENING DEVICES

BACKGROUND OF THE INVENTION

1. Field of the Invention

This invention relates to closure fastening devices, and more particularly, to interlocking closure fastening devices having controlled separation characteristics.

2. Description of the prior Art

Generally, closure fastening devices for use with plastic bags and the like are well-known. In addition, manufacturing methods for closure devices made of plastic material are generally known.

Closure fastening devices for use with plastic bags should be relatively easy to open and close and also provide a satisfactory seal. However, prior art closure fastening devices sometimes lack significant controlled separation characteristics. The controlled separation of a closure device may be described as its ability not to open freely much more than the initial gap induced by the separating force of the user. This lack of significant controlled separation manifests itself during opening of a plastic container or bag and is especially troublesome to a user during the closing or sealing operation of the container. More specifically when plastic bags having closure fastening devices are partially opened, they can continue to open completely with little or no separating force applied to the fastening devices. Such a characteristic is desirable for opening the plastic bag but presents a disadvantage on closure since the user often desires to expel the preponderance of air from the bag prior to sealing. This is most desirably accomplished if the major portion of the fastening device is interlocked, and only a small aperture remains for expelling most of the residual air from the bag before accomplishing the final closure and sealing.

Various types of such closure fastening devices may be connected to the opening of a container to form a container capable of being closed and opened. One such closure fastening device employed with a container is available from Dow Chemical Company. Midland, Mich. under the tradename ZIPLOC®. This closure fastening device comprises a first groove or female element having hook portions facing towards each other, and a second rib or male element which is arrowhead-shaped. The upper, or outside (relative to the interior of the container), engaging surface of the rib element is shorter than the lower, or inside, engaging surface of the rib element. When employed with a container, the container opens relatively easily from the outside and resists opening from the inside. Although providing some controlled opening characteristics, such a closure fastening device has a tendency to twist and distort during attempted occlusion, and thus is somewhat difficult to occlude.

Another closure fastening device employed with a container is provided by Union Carbide Corporation. Danbury, Conn., and is commercially available under the tradename SNAP LOCK®. This closure fastening device is provided with U-shaped channel elements comprising a first channel element including hook portions facing away from each other, and a second straddling channel element including hook portions facing towards each other. The channel elements interlock by pressing the first channel element into the second channel element so that the hook portions engage each other. When employed with a container, this device possesses differential deocclusion characteristics, i.e., it is easier to open from the outside of the container than from the inside of the container. Although generally easier to occlude than the Dow Chemical Company device, this fastening device does not provide significant controlled opening characteristics during deocclusion.

Another closure fastening device employed with a container is manufactured by presto products. Inc., Appleton, Wisconsin, and is available through Certified Grocers, Inc., Hodgkins, Ill. under the tradename Household Delight®. This closure fastening device comprises first and second closure elements, and further has a linear projection positioned laterally away from each of the hook portions of the first closure element, and a linear projection positioned between the hook portions of the second closure element which extends into the cavity of the hooks of the first closure element. Although providing controlled opening characteristics as a result of its substantial mass, this closure fastening device comprises a configuration having many sections requiring relatively large amounts of resin material resulting in greater material costs and likely involving a more complicated production process.

Thus, it would be desirable to provide a closure fastening device connected to a container wherein the closure fastening device has good handling properties and controlled opening characteristics while retaining a simplified structure requiring a minimum amount of resin material. This in turn would reduce cooling requirements during production, enable the use of small extruders, and require less energy per production unit.

Thus there is a continuing need to provide closure fastening devices which overcome the above-noted disadvantages and have a controlled resistance to deocclusion.

SUMMARY OF THE INVENTION

In accordance with this invention, generally speaking, there is provided an interlocking closure fastening device having an occluded height of between about 60 mils and about 85 mils, preferably about 70 mils, and a corresponding occluded width of between about 95 mils and about 125 mils, preferably about 110 mils, comprising a male closure element and a female closure element, formed such that the male closure element and the female closure element engage in interlocking relationship, wherein the male closure element includes a profile portion comprising a base portion having a pair of spaced-apart, parallelly disposed webs integrally attached to the base portion and extending therefrom, said webs terminating in hooks, and said hooks extending away from each other. The female closure element includes a profile portion comprising a base portion with a pair of spaced-apart parallelly disposed webs integrally attached to the base portion and spaced to straddle the webs on the male closure element wherein the webs on the female closure element terminate in hooks extending toward each other to engage the hooks on the male closure element.

In one embodiment of the present invention, the interdigitating hooks on one side of the closure elements may be longer, and/or larger than the interdigitating hooks on the opposite side of the closure elements to provide a controlled opening closure. In this embodiment the controlled separation characteristics of the closure fastening devices of this invention may be provided by increasing the length, and/or size of the inside male and female hooks, or the length, and/or size of the outside male and female hooks, or by increasing the length, and/or size of both the inside male and female hooks and that of the outside male and female hooks of the closure elements. However, it is preferred that the length and size of the inside male and female hooks of the closure elements be increased more than that of the outside male and female hooks of the closure elements because such has been found to provide optimum controlled resistance to deocclusion of the interlocked closure elements.

As defined herein, the inside male and female hooks of the closure elements comprise those hooks of the closure elements which are located closer to the interior portion of the container when the closure elements are attached to or made integral with the sidewalls of the container. Likewise, the outside male and female hooks of the closure elements comprise those hooks of the closure elements which are located closer to the exterior opening portion of the container when the closure elements are attached to or made integral with the sidewalls of the container. Satisfactory results are obtained when the lengths on a proportionate scale to the occluded height and occluded width of the interlocking closure fastening device of the inside hook of the male and female closure elements are from between about 8 mils and about 12 mils. Likewise satisfactory results are obtained when the lengths, on a proportionate scale to the occluded height and occluded width of the interlocking closure fastening device of the outside hook of the male and female closure elements are from between about 6 mils and about 7.5 mils.

As employed herein, the term "proportionate" is to indicate the relative proportions of the closure elements of the interlocking closure fastening device when the male and female closure elements are occluded. Thus, when the interlocking closure fastening device of this invention has an occluded height of between about 60 mils and about 85 mils and an occluded width of between about 95 mils and about 125 mils the lengths of the inside hook of the male and female closure elements are between about 8 mils and about 12 mils, and the lengths of the outside hook of the male and female closure elements are betwen about 6 mils and about 7.5 mils on a porportionate scale to the occluded height and occluded width of the interlocking closure fastening device. Accordingly when the occluded height and occluded width of the interlocking closure fastening device of this invention are either increased or decreased, then the lengths of the inside and outside hooks of the male and female closure elements should be proportionately increased or decreased to maintain the relative proportions of the closure elements.

In another embodiment of this invention the male closure element includes a profile portion comprising a base portion having a pair of spaced-apart parallelly disposed webs terminating in hooks extending away from each other and wherein said profile portion is formed from a relatively deform, resin material than that employed in the female closure element. In this embodiment the female closure element includes a profile portion comprising a base portion having a pair of spaced-apart, parallelly disposed webs terminating in hooks extending toward each other, and wherein the profile portion is formed from a relatively less stiff resin material than that employed to form the aforedescribed male profile portion. Further, in this embodiment it is preferred that the stiffer resin material employed in making the male closure element be selected from medium or high density polyethylene, for example, polyethylene having a density between about 0.930 to about 0.960 grams per cubic centimeter. In addition satisfactory results are obtained when the medium or high density polyethylene is employed therein at concentrations between about five percent and about one hundred percent by weight based on the weight of the male closure element. The balance of the resin material employed in making the male closure element may be selected from low density polyethylene for example, such polyethylene having a density between about 0.917 to about 0.930 grams per cubic centimeter. Likewise the less stiff resin material employed in making the female closure element may be selected from a low density polyethylene, for example, polyethylene having a density of between about 0.917 to about 0.930 grams per cubic centimeter. It has been found that the effect of the presence of medium or high density polyethylene in the male closure element is to stiffen the base portion, and the parallelly disposed webs and hooks thereon, thereby making bending of these parts more difficult during deocclusion of the closure fastening device. Due to the resulting decrease in the ability to deform the male profile portion during deocclusion it is the female profile portion that now must deform more than the male profile portion. Also, during the opening process, after an initial opening has been made in the closure fastening device, the male and female profile portions usually disengage by peeling apart. Consequently, it takes successively greater peel force to separate the female and altered male profile portions resulting in controlled separation of the closure fastening device.

Another aspect of this embodiment is to alter the materials employed in the female closure element in the same manner as just described relative to the male closure element, or in the same manner for both the female and male closure elements.

In another embodiment of this invention, a combination of the aforementioned embodiments provides interlocking closure fastening devices having controlled separation characteristics. Thus, in accordance with the preferred embodiment of this combination of embodiments, the inside hooks of the male and female closure elements have lengths on a proportionate scale to the occluded height and occluded width of the interlocking closure fastening device of between about 8 mils and about 12 mils; the outside hooks of the male and female closure elements have lengths, on a proportionate scale to the occluded height and occluded width of the interlocking closure fastening device, of between about 6 mils and about 7.5 mils; and the male or female closure element, or both, contains between about five percent and about one hundred percent by weight of a medium or high density polyethylene, as above described. The balance of the resin material employed in making the closure elements may be selected from a low density polyethylene, for example, polyethylene having a density of between about 0.917 to about 0.930 grams per cubic centimeter.

A further embodiment of this invention is a container embodying the aforementioned features.

The invention accordingly comprises the features, combination of elements and arrangement of parts which will be exemplified in constructions hereinafter set forth, and the scope of the application will be indicated in the claims.

DETAILED DESCRIPTION OF THE INVENTION

Figure 1:
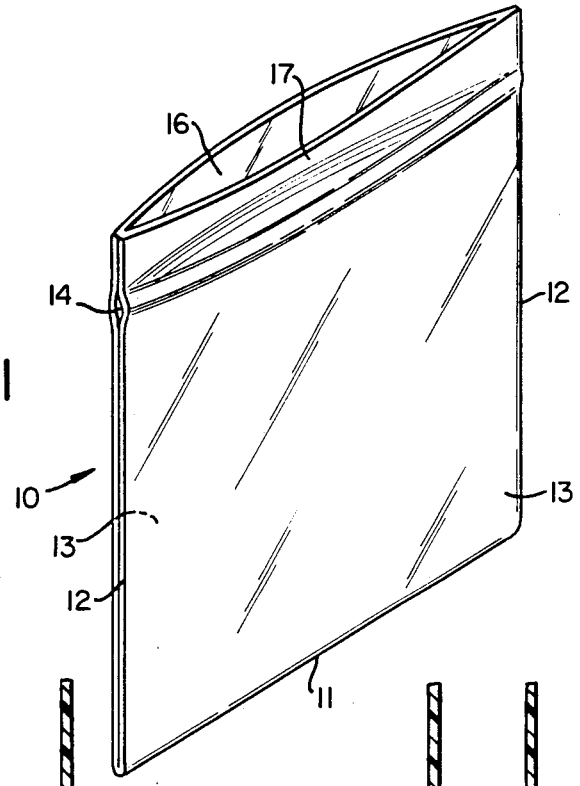
FIG. 1 is a perspective view of a flexible container including a closure fastening device in accordance with the invention.

The controlled separation characteristics of interlocking closure fastening devices, as provided by this invention, are the result of the following mechanism during deocclusion. Separation of interlocking closure fastening devices involves disengagement of entrapped fitted sections of the closure profiles. Controlled separation results when one or more fitted sections of an occluded closure profile cannot easily separate from its or their corresponding matched sections via minor bending or distortion of either of their sections. This minor bending or distortion can be inhibited by several means. Different materials can be used to form either or both of the matched sections of the closure devices so as to yield greater stiffness in the sections to be bent or distorted during deocclusion. Further, the size of matched sections can be increased or decreased to also correspondingly influence stiffness. In addition, the length of any engaging hooks of the closure devices can be increased or decreased to correspondingly cause greater or lesser entrapment of the fitted hook sections of the closure devices.

Thus, when the lengths of the inside hook of the male and female profile portions are increased, separation of the resulting closure fastening device sections from an occluded condition becomes more controlled. This controlled separation is due to greater spatial hindrance of the inside hooks during the process of deocclusion. Hindrance results from the longer inside hooks rotating, with respect to each other, and engaging each other more completely as the shorter outside hooks begin to separate, or are separating. Further inside hook rotation is prevented by the entrapment of the hook portion. Separation then becomes possible only through bending and/or distortion of the hooks, and/or adjacent areas, a process which requires greater force than the simple flexing of bases, legs and hooks during deocclusion of a conventional closure fastening device.

Generally, the closure fastening devices of this invention may be made from polyethylene, polypropylene, nylon, other thermoplastic material or the like or a combination thereof. Thus, resins or mixtures of resins other than high density polyethylene, medium density polyethylene and low density polyethylene may be employed to provide the novel separation characteristics to a closure device via resin material stiffness.

The closure fastening devices of the invention may be manufactured by extrusion, or other known methods of producing such devices. The closure fastening devices can be manufactured as individual closure elements for later attachment to a film, or the closure elements can be manufactured integral with a film. In addition, the closure fastening device can be manufactured with or without flange portions on one or both of the closure elements depending upon intended use or expected additional manufacturing operations.

In the practice of the instant invention, the closure fastening device may be integrally formed with the sidewalls of a container, or connected to a container, or to a film to be formed into a container by the use of any of many known methods. A thermoelectric device can be applied to a film in contact with the flange portion of a closure element, or the thermoelectric device can be applied to a film in contact with the base portion of a closure element having no flange portion, to cause a transfer of heat through the film to produce melting at the interface of the film and the flange portion or base portion of the closure element. On cooling the interface region joins the film and the closure element. The thermoelectric device can be heated rotary discs, or resistance heated slide wires, or traveling heater bands, or the like. The connection between the film and the closure element can also be established by the use of hot melt adhesives, or hot jets of air to the interface, or ultrasonic heating or other known methods. Generally, the closure fastening device and films can be made from a heat sealable material so that a container can be formed economically by heat sealing the aforementioned components to form the container.

The closure fastening device of this invention provides other advantages for use in containers to be used by consumers. For example the closure device is easy to occlude and does not tend to twist and distort during attempted occlusion as in the case of some prior art devices such as the arrowhead-shaped device employed with a container available under the tradename from Dow Chemical Company of Midland, Mich. This provides convenience in the occluding operation.

In addition, the closure fastening device is easier to deocclude from the outside of the container than from the inside of the container thereby providing more secure containment of goods such as food products. The profile portions of the closure device have approximately uniform cross-sections. This not only simplifies the manufacturing of the device but it also contributes to the physical flexibility of the device which is a desirable property.

In carrying the invention into effect, certain embodiments have been selected for illustration in the accompanying drawings and for description in this specification reference being had to FIGS. 1 to 7.

FIG. 1 shows a typical flexible container 10 formed from a plastic film which is folded at bottom portion 11 and is heat sealed along the side edges 12 to form a pouch. The sidewalls 13 may extend beyond a closure fastening device 14 to provide grasping sections 16 and 17 to simplify the opening of the closure fastening device 14.

Figure 2:
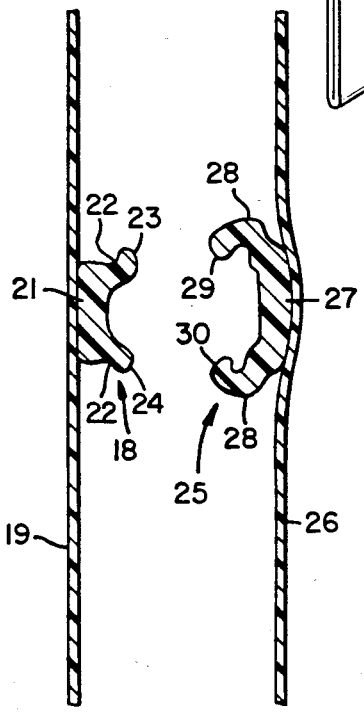
(PRIOR ART) FIG. 2
FIG. 2 shows a diagrammatic and sectional view of a deoccluded closure fastening device in accordance with the prior art.
Figure 3:
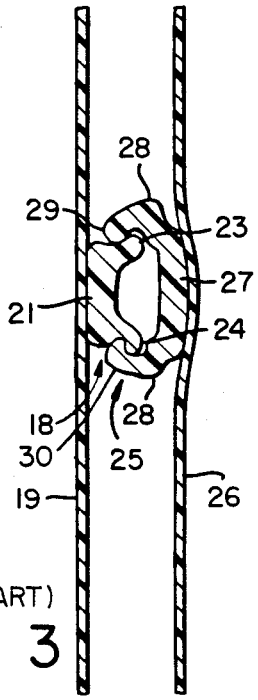
(PRIOR ART) FIG. 3
FIG. 3 shows a diagrammatic and sectional view of the closure fastening device of FIG. 2 in an occluded condition.

A prior art closure device is shown in the deoccluded and occluded conditions in FIGS. 2 and 3, respectively. A male profile portion 18 is connected to a flange portion 19 and includes a base portion 21, a pair of spaced-apart, parallelly disposed first webs 22 extending in a generally normal direction from the base portion 21, and outside hook portion 23 and inside hook portion 24 extending from webs 22 and facing away from each other. A female profile portion 25 is connected to flange portion 26 and includes a base portion 27, a pair of spaced-apart, parallelly disposed webs 28 extending in a generally normal direction from the base portion 27 and outside hook portion 29 and inside hook portion 30 extending from webs 28 and facing towards each other, profile portions 18 and 25 may be separately formed and thereafter connected to a film which forms sidewalls 13, or they may be integrally formed with sidewalls 13 as shown in FIG. 1.

profile portions 18 and 25 are occluded by pressing the male profile portion 18 into the female profile portion 25 so that the female profile straddles the male profile and the hook portions 23, 24, and 29, 30 engage together as shown in FIG. 3. During the occlusion of profile portions 18 and 25, at least one of the base portions 21 and 27 flexes or at least one of the webs 22 (not shown in FIG. 3 for purposes or clarity) and 28 flexes, or at least one of the hook portions 23, 24 and 29, 30 flexes, or a combination of these parts flex to achieve an easy occlusion.

Figure 4:
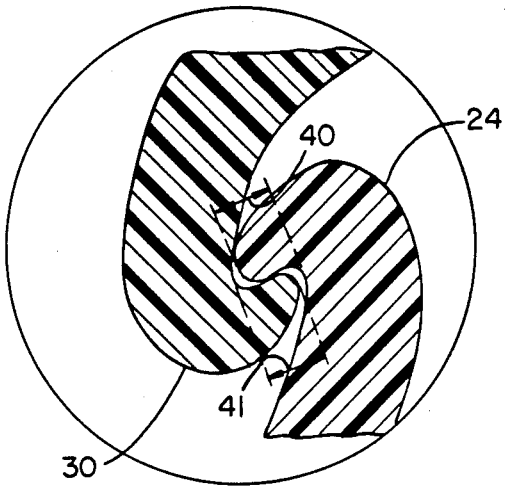
(PRIOR ART) FIG. 4
FIG. 4 shows a diagrammatic and sectional view of the inside male and female hooks of the closure fastening device of FIG. 3.

FIG. 4 shows a portion of a prior art closure fastening device. As seen therein, the inside male hook 24 and the inside female hook 30 have lengths 40 and 41 of about 6 mils each as measured between the dotted lines on a proportionate scale, to the occluded height of between about 60 mils and about 85 mils, and a corresponding occluded width of between about 95 mils and about 125 mils, of the interlocking closure fastening device.

Figure 5:
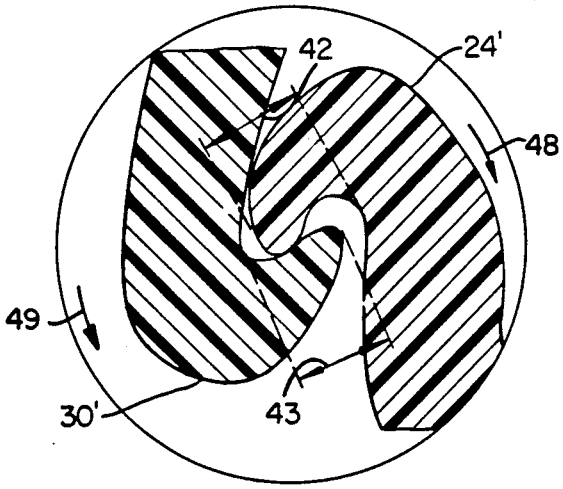
FIG. 5 shows a diagrammatic and sectional view of the inside male and female hooks of the closure fastening device in accordance with one embodiment of this invention.

FIG. 5 shows a portion of a closure fastening device in accordance with one embodiment of this invention, pursuant thereto, the inside male hook 24' and the inside female hook 30' have lengths 42 and 43 of about 10 mils each as measured between the dotted lines, on a proportionate scale, to the occluded height of between about 60 mils and about 85 mils and a corresponding occluded width of between about 95 mils and about 125 mils, of the interlocking closure fastening device. During the process of deocclusion, the inside male hook 24' will be rotated in a clockwise direction denoted by arrow 48, and the inside female hook 30' will be rotated in a counter-clockwise direction denoted by arrow 49 shown in FIG. 5.

Figure 5A:
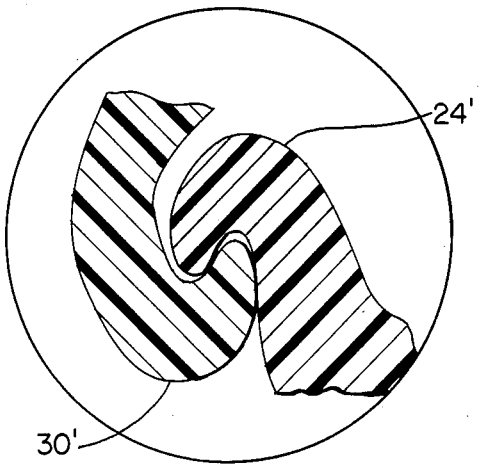
FIG. 5A shows a diagrammatic and sectional view of the inside male and female hooks of the closure fastening device of FIG. 5 in a rotated position.

FIG. 5A shows the inside male hook 24' and the inside female hook 30' of the closure fastening device of FIG. 5 in accordance with one embodiment of this invention, in a deoccluding rotated position, as during the process of deocclusion thereof, whereby the hooks are spatially hindered from further rotation, and thereby resisting further deocclusion. Thus, it can be seen that increasing the lengths of inside male hook 24' and inside female hook 30' provides spatial hindrance therebetween during the process of deoccluding the interlocking closure fastening device and results in controlled separation characteristics manifested by increased zipper strength requiring greater force to deocclude the hooks as compared to deocclusion of the inside male hook 24 and inside female hook 30 of the prior art interlocking closure fastening device shown in FIG. 4.

Figure 6:
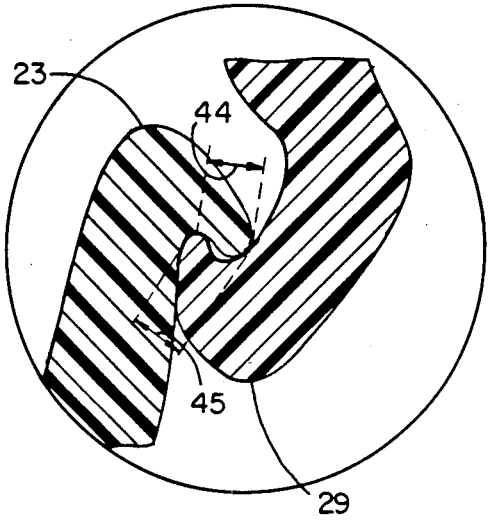
(PRIOR ART) FIG. 6
FIG. 6 shows a diagrammatic and sectional view of the outside male and female hooks of the closure fastening device of FIG. 3.

FIG. 6 shows a portion of a prior art closure fastening device. As shown therein, the outside male hook 23 and outside female hook 29 have lengths 44 and 45, respectively, on a proportionate scale to the occluded height and occluded width of the interlocking closure fastening device, of about 5 mils each as measured between the dotted lines.

Figure 7:
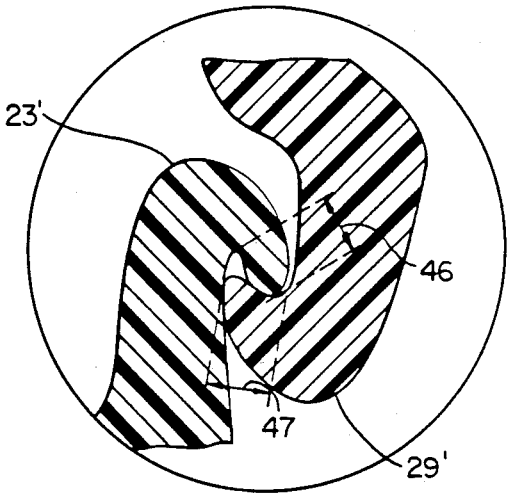
FIG. 7 shows a diagrammatic and sectional view of the outside male and female hooks of a closure fastening device in accordance with one embodiment of this invention.

FIG. 7 shows a portion of a closure fastening device in accordance with one embodiment of this invention. As shown therein, the outside male hook 23' and outside female hook 29' have lengths 46 and 47, respectively, on a proportionate scale to the occluded height and occluded width of the interlocking closure fastening device, of about 6.2 mils each as measured between the dotted lines.

In the examples, the following procedure was employed to evaluate the degree of controlled separation provided by various occluded closure fastening devices. An occluded closure fastening device sample was cut into three 12 inch long samples. The closure fastening device samples were each partially deoccluded or peeled apart at one end only. Each sample was tested independently as described herein. The partially deoccluded male portion of the closure fastening device was mounted in the upper jaw, and the female portion of the closure fastening device was mounted in the lower jaw of an Instron® tensile tester. The peel tension from the occluded closure fastening device is recorded on a strip chart recorder during deocclusion of 8 to 10 inches of the closure fastening device sample. The average value is taken visually from the near linear portion of the recording and is recorded as average zipper strength. The jaw separation (deocclusion) rate is 20 inches per minute and the full scale load is 100 grams. Each sample was reoccluded and retested for a total of 3 tests. The average value is reported for the three tests for all three samples.

The Instron instrument is a tensile tester Model No. 1130, using a "B" load cell with a zero to 100 gram range. The Instron tester is initially calibrated in the following manner. The pen and chart recorder are turned on. The zero button is pressed and held, and the zero adjust knob is positioned for a 0.00 reading on the recorder. The zero button is then released. The range switch is then turned to the setting of 1 on its 1, 2, 5, 10, 20 scale. The coarse balance control is turned so that if the pen is all the way over to the left, it starts coming towards zero on the right. The coarse balance control is left at this position. Then the fine balance control is turned so that the pen is at a setting of 0.00. A 100 gram weight is placed in the upper jaw of the Instron instrument and the calibration control is adjusted for a full-scale recorder reading. After removing the 100 gram weight, the recorder should again read 0.00. The zero button is pressed and held, and the recorder should again read 0.00.

The test results are given below in Table 1.

TABLE I

| Closure Fastening Device | Average Zipper Strength (In Grams) |
|---|---|
| Control | 8 |
| Example 1 | 20 |
| Example 2 | 26 ± 1 |
| Example 3 | 53 ± 4 |
| Example 4 | 64 |
| Example 5 | 48 |

The Control represents a channel closure fastening device produced by Union Carbide Corporation and commercially available with a container identified as SNAP LOCK ®. The Control closure fastening device was made with low density polyethylene, that is, having a density of about 0.923 grams per cubic centimeter, wherein the lengths of the inside hook of the male and female closure elements were about 6 mils. The outside hook of the male and female closure elements had lengths of about 5 mils.

Example 1 was the same as the Control except that the male profile portion contained about 25 percent by weight of high density polyethylene having a density of about 0.960 grams per cubic centimeter, the remainder being low density polyethylene having a density of about 0.923 grams per cubic centimeter.

Example 2 was the same as the Control except that the lengths of the inside hook of the male and female closure elements were about 10 mils and outside hook lengths were about 6.2 mils.

Example 3 was the same as Example 2 except that the male profile portion contained about 30 percent by weight of high density polyethylene having a density of about 0.960 grams per cubic centimeter and about 70 percent by weight of low density polyethylene having a density of about 0.923 grams per cubic centimeter.

Example 4 represents a closure fastening device employed with a container available from Certified Grocers. Inc. Hodgkins. Ill. under the tradename Household Delight. The closure fastening device is believed to have been made with low density polyethylene having a density of about 0.927 grams per cubic centimeter wherein the lengths of the inside hook of the male and female closure elements were about 15 mils. The outside hook of the male and female closure elements had lengths of about 15 mils. In addition, the web portions of the female closure element were about 50% thicker than those of the female closure element of Example 3, Likewise, the web portions of the male closure element were about 100% thicker than those of the male closure element of Example 3, Further, the flanges of the male and female closure element in the region of the base portion of the closure fastening device were about twice as large or thick, as those of the male and female closure elements of Example 3. The net effect of these dimensions is that the device of Example 4 contains at least about 40% more resin in the closure profile portion than in that of the device of Example 3. More particularly, the closure device of Example 4 weighs about 4.16 grams per lineal foot, while that of Example 3 weighs about 2.45 grams per lineal foot.

Example 5 represents a closure fastening device employed with a container available from Dow Chemical Company, Midland, Mich. under the tradename ZIPLOC ®. The closure fastening device is believed to have been made with low density polyethylene having a density of about 0.921 grams per cubic centimeter. The length of the inside hook and outside hook portions of the groove or female element were about 9 mils, and about 6.5 mils, respectively. In addition, the rib or male element was arrowhead-shaped wherein its upper, or outside (relative to the interior of the container), engaging surface was shorter than the lower, or inside, engaging surface. The web portions of the groove or female element and the flanges of the female and male closure elements in the region of the base portion of the closure fastening device had about the same size or thickness as those of the male and female closure elements of Example 3.

From the above results in Table 1, the average zipper strength values given represent the amount of resistance encountered to further opening of the partially deoccluded closure fastening devices. This value is measured in grams when peeling or zippering the male and female portions apart in the lengthwise direction. It can be seen from the above values that increasing the length of the inside hooks of the closure fastening device increases its zipper strength, and the addition of high density polyethylene to the material composition further increases its zipper strength. Thus, increasing the length of the inside hooks as in Example 2 increases the zipper strength of a closure fastening device. Further, it can be seen that both increasing the length of the inside hooks and employing as little as 30 percent by weight of higher density polyethylene in the profile portion of the male closure element as in Example 3 provides a closure fastening device having controlled separation characteristics that are substantially equivalent to a device wherein the length of the inside and outside hooks is greater, and the webs of the male and female profile portions are substantially larger as in Example 4. However, the closure fastening device of Example 4 requires substantially more resin material than that of Example 3, requires more production energy, and is more expensive to produce. Since the structure of the male closure element of Example 5 is nonanalogous to that of the Control and Examples 1 to 4, no direct comparison can be made as to the effect of varying the dimensions and materials of construction of this closure fastening device.

Further, the closure fastening devices of the Control and Examples 1, 2 and 3 were easier to occlude than that of Example 5, and did not tend to twist or distort during attempted occlusion of the devices. In addition, the devices of the Control and Examples 1, 2 and 3 were easier to deocclude from the outside than from the inside of the containers.

In addition to use with a reclosable container, the closure fastening devices of this invention can be used to electrically insulate wire leads or bind together a group of wires. A closure fastening device in accordance with this invention can also be used as a flexible straw because a good seal at the engaged surfaces is possible and a compartment defined by the occluded closure elements provides a passageway which does not collapse when the closure fastening device is bent moderately.

Generally, the closure fastening devices of this invention can be manufactured in a variety of forms to suit the intended use. In addition, the male and female closure elements can be positioned on opposite sides of a film. Such an embodiment would be suited for enwrapping an object or a collection of objects such as wires. Generally, the male and female closure elements on a film should be parallel to each other but this would depend on the intended use.

I wish it to be understood that I do not desire to be limited to the exact details of construction shown and described for obvious modifications will occur to a person skilled in the art.

Having thus described the invention what I claim as new and desire to be secured by Letters patent is as follows:

1. In an interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a profile portion comprising a base portion having a pair of spaced-apart, parallelly disposed webs integrally attached to said base portion and extending therefrom, said webs terminating in a pair of hooks extending away from each other, one of said pair of hooks of said male closure element forming one of the hooks of said pair of outside hooks of said fastening device, and one of said pair of hooks of said male closure element forming one of the hooks of said pair of inside hooks of said fastening device; and a female closure element including a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said profile portion of said male closure element comprises a stiffer resin material than the resin material of said female closure element.

2. An interlocking closure fastening device with claim 1 wherein said profile portion of said male closure element comprises medium or high density polyethylene and said female closure element comprises low density polyethylene.

3. An interlocking closure fastening device in accordance with claim 2 wherein said medium or high density polyethylene has a density between about 0.930 to about 0.960 grams per cubic centimeter.

4. An interlocking closure fastening device in accordance with claim 2 wherein said medium or high density polyethylene is present at concentrations between about five percent and about one hundred percent by weight based on the weight of said profile portion.

5. An interlocking closure, fastening device in accordance with claim 2 wherein said low density polyethylene has a density between about 0.917 to about 0.930 grams per cubic centimeter.

6. In an interlocking closure fastening device having an occluded height of between about 60 mils and about 85 mils, and a corresponding occluded width of between about 95 mils and about 125 mils, said interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a profile portion comprising a base portion having a pair of spaced-apart, parallelly disposed webs integrally attached to said base portions and extending therefrom, said webs terminating in a pair of hooks extending away from each other, one of said pair of hooks of said male closure element forming one of the hooks of said pair of outside hooks of said fastening device, and one of said pair of hooks of said male closure element forming one of the hooks of said pair of inside hooks of said fastening device; and a female closure element including a profile portion comprising a base portion having a pair of spaced-apart, parallelly disposed webs integrally attached to said base portion and spaced to straddle said webs on said male closure element wherein said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said profile portion of said male closure element comprises a stiffer resin material than the resin material of said female closure element.

7. An interlocking closure fastening device in accordance with claim 6 wherein said profile portion of said male closure element comprises medium or high density polyethylene and said female closure element comprises low density polyethylene.

8. An interlocking closure fastening device in accordance with claim 7 wherein said medium or high density polyethylene has a density between about 0.930 to about 0.960 grams per cubic centimeter.

9. An interlocking closure fastening device in accordance with claim 7 wherein said medium or high density polyethylene is present at concentrations between about five percent and about one hundred percent by weight based on the weight of said profile portion.

10. An interlocking closure fastening device in accordance with claim 7 wherein said low density polyethylene has a density between about 0.917 to about 0.930 grams per cubic centimeter.

11. In an interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a flange portion attached to a profile portion comprising a base portion having a pair of spaced-apart, parallelly disposed webs integrally attached to said base portion and extending therefrom, said webs terminating in a pair of hooks extending away from each other, one of said pair of hooks of said male closure element forming one of the hooks of said pair of outside hooks of said fastening device, and one of said pair of hooks of said male closure element forming one of the hooks of said pair of inside hooks of said fastening device; and a female closure element including a flange portion attached to a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element; one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said profile portion of said female closure element comprises a stiffer resin material than the resin material of said flange portion of said female closure element, and the resin material of said male closure element.

12. An interlocking closure fastening device in accordance with claim 11 wherein said profile portion of said female closure element comprises medium or high density polyethylene, and said flange portion of said female closure element and said male closure element comprise low density polyethylene.

13. An interlocking closure fastening device in accordance with claim 12 wherein said medium or high density polyethylene has a density between about 0.930 to about 0.960 grams per cubic centimeter.

14. An interlocking closure, fastening device in accordance with claim 12 wherein said low density polyethylene has a density between about 0.917 to about 0.930 grams per cubic centimeter.

15. An interlocking closure fastening device in accordance with claim 12 wherein said medium or high density polyethylene is present at concentrations between about five percent and about one hundred percent by weight based on the weight of said profile portion.

16. In an interlocking closure fastening device having an occluded height of between about 60 mils and about 85 mils, and a corresponding occluded width of between about 95 mils and about 125 mils, said interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a flange portion attached to a profile portion comprising a base portion having a pair of spaced-apart, parallelly disposed webs integrally attached to said base portion and extending therefrom, said webs terminating in a pair of hooks extending away from each other, one of said pair of hooks of said male closure element forming one of the hooks of said pair of outside hooks of said fastening device, and one of said pair of hooks of said male closure element forming one of the hooks of said pair of inside hooks of said fastening device; and a female closure element including a flange portion attached to a profile portion comprising a base portion having pair of spaced-apart, parallelly disposed webs integrally attached to said base portion and spaced to straddle said webs on said male closure element wherein said webs on said female closure element terminate in a pair of hook extending toward each other to engage said hooks on said male closure element; one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said profile portion of said female closure element comprises a stiffer resin material than the resin material of said flange portion of said female closure element, and the resin material of said male closure element.

17. An interlocking closure fastening device in accordance with claim 16 wherein said profile portion of said female closure element comprise medium or high density polyethylene, and said flange portion of said female closure element and said male closure element comprise low density polyethylene.

18. An interlocking closure fastening device in accordance with claim 17 wherein said medium or high density polyethylene has a density between about 0.930 to about 0.960 grams per cubic centimeter.

19. An interlocking closure fastening device accordance with claim 17 wherein said low density polyethylene has a density between about 0.917 to about 0.930 grams per cubic centimeter.

20. An interlocking closure fastening device in accordance with claim 17 wherein said medium or high density polyethylene is present at concentrations between about five percent and about one hundred percent by weight based on the weight of said profile portion.

21. In an interlocking closure fastening device having controlled separation characteristics, said interlocking closure fastening device including a pair of outside hooks and a pair of inside hooks, and comprising u-shaped channel element; said channel elements comprising a male closure element formed to engage a female closure element in interlocking relationship wherein said male closure elements includes a flange portion attached to a profile portion comprising a base portion having a pair of spaced-apart, parallelly disposed webs integrally attached to said base portion and extending therefrom, said webs terminating in a pair of hooks extending away from each other, one of said pair of hooks of said male closure element forming one of the hooks of said pair of outside hooks of said fastening device, and one of said pair of hooks of said male closure element forming one of the hooks of said pair of inside hooks of said fastening device; and a female closure element including a flange portion attached to a profile portion comprising a bases portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said profile portion of said male closure element comprises a stiffer resin material than the resin material of said flange material of said female closure element; and said hooks forming said pair of inside hooks have a length longer than said hooks forming said pair of outside hooks.

22. An interlocking closure fastening device in accordance with claim 21 wherein said hooks forming said pair of outside hooks have a length longer than said hooks forming said pair of inside hooks.

23. In an interlocking closure fastening device having an occluded height of between about 60 mils and about 85 mils, and a corresponding occluded width of between about 95 mils and about 125 mils, said interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a flange portion attached to a profile portion comprising a base portion having a pair of spaced-apart, parallelly disposed webs integrally attached to said base portion and extending therefrom, said webs terminating in a pair of hooks extending away from each other, one of said pair of hooks of said male closure element forming one of the hooks of said pair of outside hooks of said fastening device, and one of said pair of hooks of said male closure element forming one of the hooks of said pair of inside hooks of said fastening device; and a female closure element including a flange portion attached to a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said profile portion of said male closure element comprises a stiffer resin material than the resin material of said flange portion of said male closure element, and the resin material of said female closure element; and said hooks forming said pair of inside hooks have a length longer than said hooks forming said pair of outside hooks.

24. An interlocking closure fastening device in according with claim 23 wherein said pair of outside hooks have lengths, on a proportionate scale to the occluded height and occluded width of said interlocking closure fastening device, of between about 6 mils and about 7.5 mils and said pair of inside hooks have lengths, on a proportionate scale to the occluded height and occluded width of said interlocking closure fastening device, of between about 8 mils and about 12 mils.

25. An interlocking closure fastening device in accordance with claim 23 wherein said stiffer resin material comprises medium or high density polyethylene having a density of between about 0.930 to about 0.960 grams per cubic centimeter.

26. An interlocking closure fastening device in accordance with claim 23 wherein said stiffer resin material is present at concentrations between about five percent and about one hundred percent by weight based on the weight of said profile portion.

27. In an interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a flange portion attached to a profile portion comprising a base portion having a pair of spaced-apart, parallelly disposed webs integrally attached to said base portion and extending thereform, said webs terminating in a pair of hooks extending away form each other, one of said pair of hooks of said male closure element forming one of the hooks of said pair of outside hooks of said fastening device, and one of said pair of hooks of said male closure element forming one of the hooks of said pair of inside hooks of said fastening device; and a female closure element including a flange portion attached to a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said flange portion of said male closure element comprises low density polyethylene and said profile portion of said male closure element comprises medium or high density polyethylene;

said female closure element comprises low density polyethylene; and said hooks forming said pair of inside hooks have a length longer than said hooks forming said pair of outside hooks.

28. An interlocking closure fastening device in accordance with claim 27 wherein said hooks forming said pair of outside hooks have a length longer than said hooks forming said pair of inside hooks.

29. In an interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a flange portion attached to a profile portion comprising a base portion having a pair of spaced-apart, parallelly disposed webs integrally attached to said base portion and extending thereform, said webs terminating in a pair of hooks extending away from each other, one of said hooks of said male closure element forming one of the pair of hooks of said pair of outside hooks of said fastening device, and one of said hooks of said male closure element forming one of the pair of hooks of said pair of inside hooks of said fastening device; and a female closure element including a flange portion attached to a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said flange portion of said male closure element comprises low density polyethylene and said profile portion of said male closure element comprises medium to high density polyethylene;

said female closure element comprises low density polyethylene; and said profile portion of said male closure element comprises a stiffer resin material than the resin material of said female closure element.

30. In an interlocking closure fastening device having an occluded height of between about 60 mils and about 85 mils, and a corresponding occluded width of between about 95 mils and about 125 mils, said interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a flange portion attached to a profile portion comprising a base portion having a pair of spaced-apart, parallelly disposed webs integrally attached to said base portion and extending therefrom, said webs terminating in a pair of hooks extending away from each other, one of said hooks of said male closure element forming one of the pair of hooks of said pair of outside hooks of said fastening device, and one of said hooks of said male closure element forming one of the pair of hooks of said pair of inside hooks of said fastening device; and a female closure element including a flange portion attached to a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said flange portion of said male closure element comprises low density polyethylene and said profile portion of said male closure element comprises medium or high density polyethylene;

said female closure element comprises low density polyethylene; and said profile portion of said male closure element comprises a stiffer resin material than the resin material of said female closure element.

31. In an interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a flange portion attached to a profile portion comprising a base portion having a pair of spaced-apart, parallelly disposed webs integrally attached to said base portion and extending therefrom, said webs terminating in a pair of hooks extending away from each other, one of said hooks of said male closure element forming one of the pair of hooks of said pair of outside hooks of said fastening device, and one of said hooks of said male closure element forming one of the pair of hooks of said pair of inside hooks of said fastening device; and a female closure element including a flange portion attached to a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said male closure element comprises low density polyethylene, said flange portion of said female closure element comprises low density polyethylene, said profile portion of said female closure element comprises medium or high density polyethylene; and said hooks forming said pair of inside hooks have a length longer than said hooks forming said pair of outside hooks.

32. An interlocking closure fastening device in accordance with claim 31 wherein said hooks forming said pair of outside hooks have a length longer than said hooks forming said pair of inside hooks.

33. In an interlocking closure fastening device having an occluded height of between about 60 mils and about 85 mils, and a corresponding occluded width of between about 95 mils and about 125 mils, said interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element interlocking relationship wherein said male closure element includes a flange portion attached to a profile portion comprising a base portion having a pair of spaced-apart, parallelly disposed webs integrally attached to said base portion and extending therefrom, said webs terminating in a pair of hooks extending away from each other, one of said hooks of said male closure element forming one of the hooks of said pair of outside hooks of said fastening device, and one of said hooks of said male closure element forming one of the pair of hooks of said pair of inside hooks of said fastening device; and a female closure element including a flange portion attached to a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said male closure element comprises low density polyethylene, said flange portion of said female closure element comprises low density polyethylene, said profile portion of said female closure element comprising medium or high density polyethylene; and said hooks forming said pair of inside hooks have a length longer than said hooks forming said pair of outside hooks.

34. An interlocking closure fastening device in accordance with claim 33 wherein said hooks forming said pair of outside hooks have a length longer than said hooks forming said pair of inside hooks.

35. An interlocking closure fastening device in accordance with claim 33 wherein said pair of outside hooks have lengths, on a porportionate scale to the occluded height and occluded width of said interlocking closure fastening device, of between about 6 mils and about 7.5 mils and said pair of inside hooks have lengths, on a proportionate scale to the occluded height and occluded width of said interlocking closure fastening device, of between about 8 mils and about 12 mils.

36. An interlocking closure fastening device in accordance with wherein said medium or high density polyethylene has a density between about 0.930 to about 0.960 grams per cubic centimeter.

37. An interlocking closure fastening device in accordance with said medium or high density polyethylene is present at concentrations between about five percent and about one hundred percent by weight based on the weight of said profile portion.

38. An interlocking closure fastening device in accordance with claim 33 wherein said low density polyethylene has a density between about 0.917 to about 0.930 grams per cubic centimeter.

39. An interlocking closure fastening device in accordance with claim 33 further including a film connected to said male closure element and said female closure element.

40. An interlocking closure fastening device in accordance with claim 39 wherein said hooks of said profile portion of said male closure element and said hooks of said profile portion of said female closure element are positioned facing toward each other.

41. In a container including an interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a profile portion comprising a base portion having a pair of spaced-apart, parallelly disposed webs integrally attached to said base portion and extending therefrom, said webs terminating in a pair of hooks extending away from each other, one of said hooks of said male closure element forming one of the pair of hooks of said pair of outside hooks of said fastening device, and one of said hooks of said male closure element forming one of the pair of hooks of said pair of inside hooks of said fastening device; and a female closure element including a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said profile portion of said male closure element comprises a stiffer resin material than the resin material of said female closure element.

42. In a container including an interlocking closure fastening device having an occluded height of between about 60 mils and about 85 mils, and a corresponding occluded width of between about 95 mils and about 125 mils, said interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a profile portion comprising a base portion having a pair of spaced-apart, parallelly disposed webs integrally attached to said base portion and extending therefrom, said webs terminating in a pair of hooks extending away from each other, one of said hooks of said male closure element forming one of the pair of hooks of said pair of outside hooks of said fastening device, and one of said hooks of said male closure element forming one of the pair of hooks of said pair of inside hooks of said fastening device; and a female closure element including a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said profile portion of said male closure element comprises a stiffer resin material than the resin material of said female closure element.

43. In a container including an interlocking closure fastening deice having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a profile portion comprising a base portion having a pair of spaced-apart, parallelly disposed webs integrally attached to said base portion and extending therefrom, said webs terminating in a pair of hooks extending away from each other, one of said hooks of said male closure element forming one of the pair of hooks of said pair of outside hooks of said fastening device, and one of said hooks of said male closure element forming one of the pair of hooks of said pair of inside hooks of said fastening device; and a female closure element including a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said male closure element comprises low density polyethylene, said profile portion of said female closure element comprises medium or high density polyethylene, and said profile portion of said female closure element comprises a stiffer resin material than the resin material of said male closure element.

44. A container in accordance with claim 43 wherein said medium or high density polyethylene has a density between about 0.930 to about 0.960 grams per cubic centimeter.

45. In a container including an interlocking closure fastening device having an occluded height of between about 60 mils and about 85 mils, and a corresponding occluded width of between about 95 mils and about 125 mils, said interlocking closure fastening device having controlled separation characteristics, said interlocking closure fastening device including a pair of outside hooks and a pair of inside hooks, and comprising u-shaped channel elements; said channel elements comprising a male closure element formed to engage a female closure element in interlocking relationship wherein said male closure element includes a profile portion comprising a base portion having a pair of spaced-apart, parallelly disposed webs integrally attached to said base portion and extending therefrom, said webs terminating in a pair of hooks extending away from each other, one of said hooks of said male closure element forming one of the pair of hooks of said pair of outside hooks of said fastening device, and one of said hooks of said male closure element forming one of the pair of hooks of said pair of inside hooks of said fastening device; and a female closure element including a profile portion comprising a base portion having a pair of spaced-apart, parallelly disposed webs integrally attached to said base portion and spaced to straddle said webs on said male closure element wherein said webs on said female closure element terminate in a pair of hooks extending toward each other to engage said hooks on said male closure element, one of said pair of hooks of said female closure element forming one of the hooks of said pair of outside hooks of said fastening device, and one of said pair of hooks of said female closure element forming one of the hooks of said pair of inside hooks of said fastening device;

the improvement comprising said male closure element comprises low density polyethylene, said profile portion of said female closure element comprises medium or high density polyethylene, and said profile portion of said female closure element comprises a stiffer resin material than the resin material of said male closure element.

46. A container in accordance with claim 45 wherein said medium or high density polyethylene has a density between about 0.930 to about 0.960 grams per cubic centimeter.

* * * * *

UNITED STATES PATENT AND TRADEMARK OFFICE

CERTIFICATE OF CORRECTION

PATENT NO. : 4,795,269

DATED : June 30, 1989

INVENTOR(S) : Gerald H. Scheibner

It is certified that error appears in the above-identified patent and that said Letters Patent is hereby corrected as shown below:

Column 2, line 10: Delete "presto products" and replace with --Presto Products--.

Column 3, line 46: Delete "betwen" and replace with --between--.

Column 3, line 47: Delete "porportionate" and replace with --proportionate--.

Column 3, line 61: Following "relatively" insert --more stiff, that is, more difficult to bend or-- before the word "deform".

Column 6, line 52: Following "tradename" insert --ZIPLOC®-- before the word "from".

Column 7, line 44: Following "invention" insert --.--. delete ",".

Column 7, line 45: Delete "pursuant" and replace with --Pursuant--.

Column 9, line 49: Replace "3," with --3.--.

Column 9, line 52: Replace "3," with --3.--.

Column 9, line 53: Replace the word "element" with --elements--.

Column 11, line 10: Insert the word --CLAIMS:--.

Column 11, line 48: Following the word "device" insert --in accordance-- before the word "with".

Column 15, line 9: Following "said flange" delete the word "material" and replace therefor --portion of said male closure element, and the resin material--.

UNITED STATES PATENT AND TRADEMARK OFFICE

CERTIFICATE OF CORRECTION

PATENT NO. : 4,795,269

DATED : June 30, 1983

INVENTOR(S) : Gerald H. Scheibner

It is certified that error appears in the above-identified patent and that said Letters Patent is hereby corrected as shown below:

Column 19, line 55: Following the word "with" insert --claim 33--.

Column 19, line 59: Following the word "with" insert --claim 33 wherein--.

Signed and Sealed this

Ninth Day of October, 1990

*Attest:*

*Attesting Officer*

HARRY F. MANBECK, JR.

*Commissioner of Patents and Trademarks*